US005611538A

United States Patent [19]

Ehrenfeucht

[11] Patent Number: 5,611,538

[45] Date of Patent: Mar. 18, 1997

[54] ALIGNMENT BOARD GAME APPARATUS AND METHOD

[75] Inventor: Andrzej Ehrenfeucht, Boulder, Colo.

[73] Assignee: Aristoplay, Ltd., Ann Arbor, Mich.

[21] Appl. No.: 437,699

[22] Filed: May 9, 1995

[51] Int. Cl.[6] ..... A63F 3/00

[52] U.S. Cl. ..... 273/271; 273/264; 273/269

[58] Field of Search ..... 273/271, 264, 273/269, 275, 287, 153 R; 434/188, 209, 128

[56] References Cited

U.S. PATENT DOCUMENTS

| | | | |
|---|---|---|---|
| 1,564,746 | 12/1925 | Barnard | 273/271 |
| 1,723,377 | 8/1929 | Salomon | 273/269 |
| 3,549,150 | 12/1970 | Weeks | 273/269 |
| 3,869,124 | 3/1975 | Stein et al. | 434/209 |
| 4,126,315 | 11/1978 | Tung | 273/271 |
| 4,213,616 | 7/1980 | Dickey | 273/271 |
| 4,883,277 | 11/1989 | Laisure | 273/265 |
| 5,219,289 | 6/1993 | Derr | 434/188 |
| 5,417,425 | 5/1995 | Blumberg et al. | 273/153 R |

*Primary Examiner*—William M. Pierce
*Attorney, Agent, or Firm*—Gifford, Krass, Groh, Sprinkle, Patmore, Anderson & Citkowski

[57] ABSTRACT

Board game apparatus of the Tic Tac Toe variety consisting of a pair of square matrix grid game boards each containing a square grid playing area defined by a plurality of grid units existing in a number of criss cross and diagonal rows. Each of the grid units is capable of containing a game playing piece or other designation for at least partially covering the grid unit in which logical deployment of a plurality of game playing pieces are used by players during alternating designated turns to cover an entire row of the grid units on one of the boards to determine the winner of the game. Each of the boards contains sixteen grid unit identification symbols, all of the symbols on each board being different from each other and both boards containing the same number of grid units, thus the same number of symbols. The symbols are arranged in a random pattern on one of the boards and in a different pattern on the other board so that none of the symbols on the second board are located on the same grid unit as on the first board.

10 Claims, 2 Drawing Sheets

ALIGNMENT BOARD GAME APPARATUS AND METHOD

BACKGROUND OF THE INVENTION

The present invention relates to board games and more particularly to mathematical based board games.

Board games are well known in the art and so are mathematical based board games. An example is U.S. Pat. No. 4,126,315 which in turn lists numerous other patents relating to board games of this general type. However, many of the games of this type are so complex that they appeal only to a mathematical elitist group of players who can handle sequential and combinational analysis in order to consistently win.

The game of the present invention, however, is of the "tic tac toe" type of game which is very simple and can be played over short time periods. The game of this invention is, however, played with two boards and is of sufficient complexity to present a challenge both to casual and experienced players.

SUMMARY OF THE INVENTION

Human beings have been playing games for centuries, but the mathematical theory of games is a creation of this century. The game board apparatus of this invention belongs to the Tic Tac Toe family of games which are generally regarded as simple, easy-to-play games.

The game that it is played with the game board apparatus of this invention was not developed by trial and error but was constructed on the basis of an algebraic principle that makes this simple game somewhat difficult so that the game is not merely a game of chance. A player must find the right move at the right time by a reasoning process. More experienced players develop strategies, namely, general plans for playing the game. Developing strategies for the game is not an easy task. The game was designed in such a way that no simple rule, such as "play in the middle" or "play on the star first" works. Designing a strategy is an abstract task but using it correctly also requires adjusting the plan to the concrete pattern seen on the two boards.

The present invention relates to a mathematical based board game apparatus for at least two players or two teams. The apparatus includes a pair of square matrix grid game boards, each containing a square grid playing area defined by a plurality of grid units existing in a plurality of criss cross and diagonal rows. Each of the grid units is capable of containing a game playing piece thereon, such as a chip, for at least partially covering the grid unit.

The players, during alternating designated turns, attempt to logically deploy a plurality of the game playing pieces so as to cover an entire row of the grid units on one of the boards to determine the winner of the game. Each of the boards contains grid unit identification symbols, all of the symbols on each board being different from each other, with both boards containing the same number of grid units and the symbols on one board being arranged so that substantially none of the symbols thereon are located on the same grid unit as the corresponding symbols on the other board.

In the preferred embodiment of this invention, all of the symbols on each of the boards are different from each other, both boards containing the same number of grid units, namely, sixteen arranged so that there are eight rows of symbols arranged in criss cross rows and two rows of symbols arranged in diagonal rows.

In the preferred embodiment of the invention, each board has sixteen distinctly different symbols, these symbols being of four distinctly different shapes and designs. The symbols are also selected from four different colors so that there are four symbols on each board of each of the four colors.

The symbols can be randomly arranged on the first board. The arrangement of the symbols on the second board are located pursuant to linear equations or formulas so that a grid unit on the second board will not have a symbol that is the same as the symbol on the corresponding grid unit on the other board.

The result is a challenging game which can be played by inexperienced as well as experienced players with genuine enjoyment.

Further objects, features and advantages of the invention will become apparent from the attached specification, the appended claims and the drawing.

DESCRIPTION OF THE PREFERRED EMBODIMENT OF THE INVENTION

Figure 1:
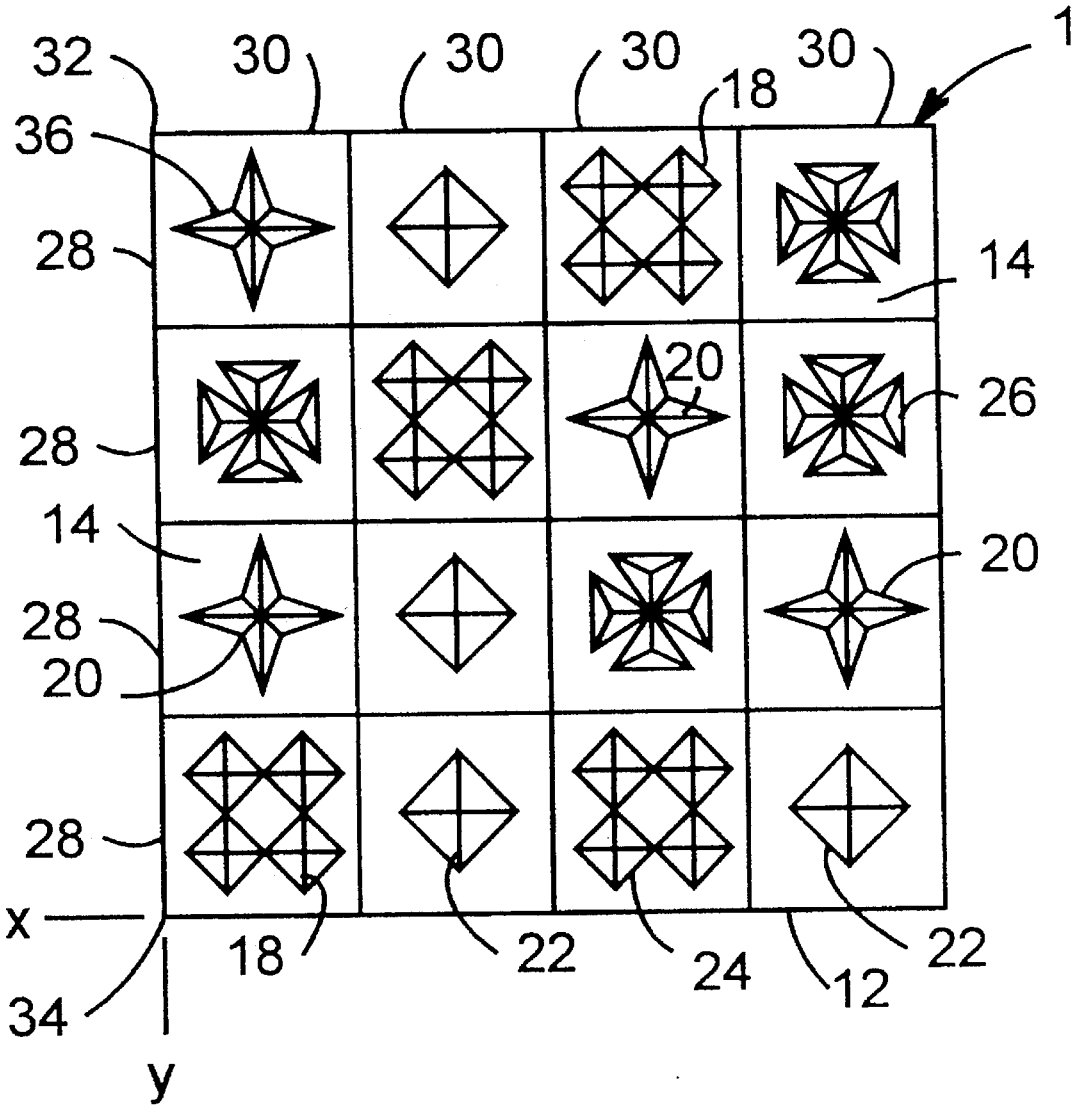
FIG. 1 is a plan view of one of the boards in the game apparatus of this invention.
Figure 2:
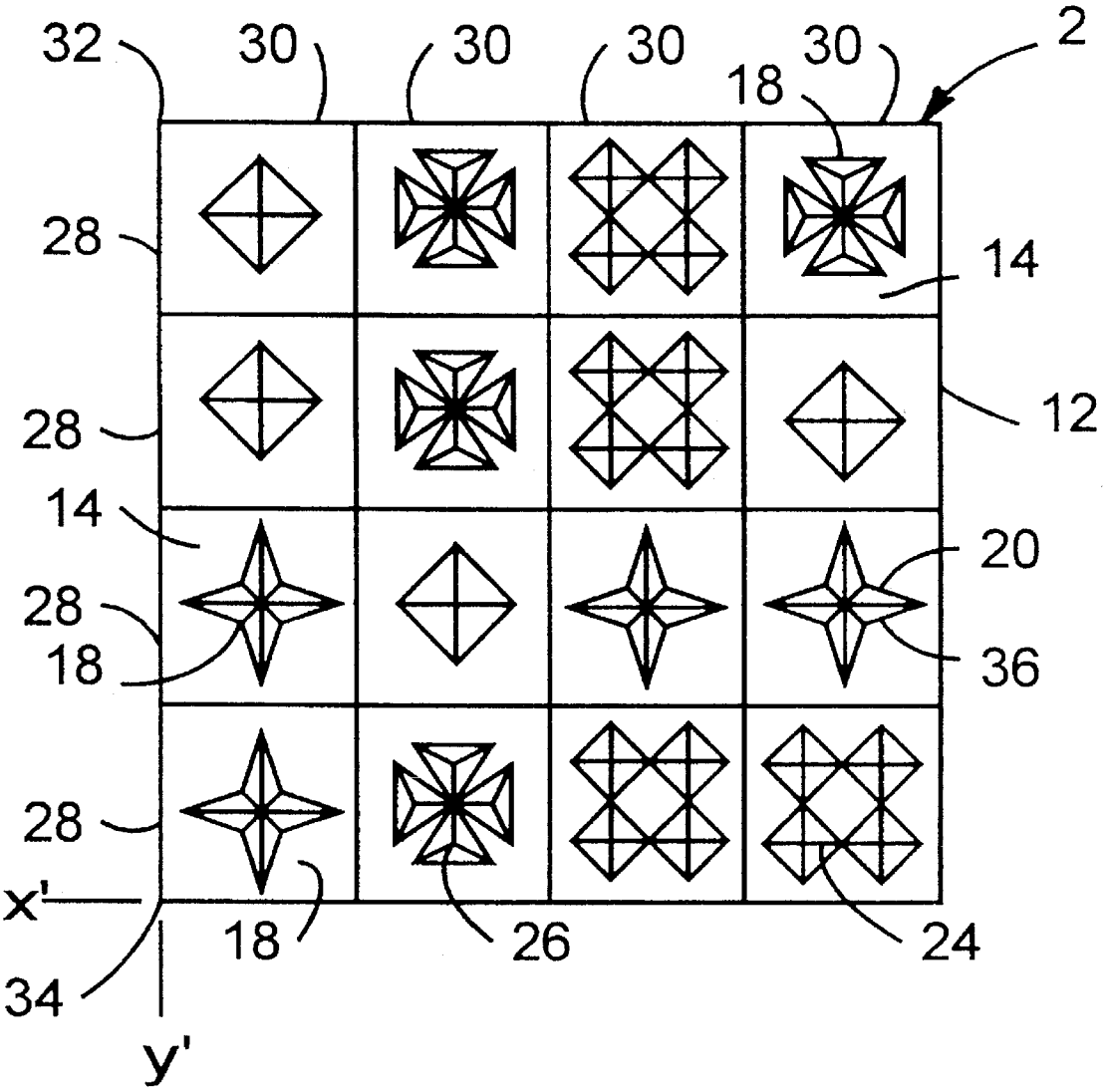
FIG. 2 is a plan view of the other board in the game board apparatus of this invention.

The game board apparatus of this invention consists of two very similar boards, one board being indicated generally at 1 in FIG. 1 and the second board being indicated generally at 2 in FIG. 2. Each board is a square matrix grid 12 containing a square grid playing area defined by sixteen grid units 14 each of which is also defined by a square area which is identified by an easily recognizable icon or symbol 18. It should be noted that each of the illustrated boards 1 and 2 have four different symbols, namely, stars 20, diamonds 22, four squares 24 and four-triangles 26. Each of the shaped icons 20, 22, 24, and 26 appear four times on each board in four different colors, for example, green, blue, yellow and red.

It should be noted that the symbols 18 are arranged in a plurality of criss cross and diagonal rows. More particularly, each board has four rows 28 which are horizontal and parallel to the "x" axis. Similarly, there are four vertical rows or columns 30 parallel to the "y" axis and two diagonal rows 32 and 34. In FIG. 1, the horizontal and vertical axes are labeled x and y. In FIG. 2, the corresponding axes are labeled x' and y' for a reason to become apparent shortly.

It is important to note that the board 1 has all of the symbols thereon arranged so that no symbol such as a star 20, square 22, a four-square 24 or a four-triangle 26 of one of the colors green, blue, yellow or red is positioned in the same grid unit on board 2 as the corresponding grid unit 14 on board 1. This is due to the fact that the symbols 18 on the board 12 are arranged in accordance with linear equations which will shortly be described in detail. However, it should be noted that it is within the purview of the invention to randomly arrange the symbols 18 on the board 2 so that all or substantially all of the symbols 18 are arranged on different grid units on board 2 than they are on board 1. The resulting game that is played on such boards would retain most of the attributes of the preferred embodiment of this invention.

The game is played on the boards 1 and 2, which can be in printed form or on other media such as a computer screen, by using chips or the equivalent thereof to designate selected grid units 14 which are being reserved by those playing the game. The game is usually played by two players, hereinafter referred to as A and B for convenience of description. Player A has sixteen white chips and Player B has sixteen black chips in this illustration.

The players take alternating designated turns to place chips on the grid units 14. The object is to cover an entire row 28, 30, 32 or 34 on one of the boards to win the game.

The game is started by player A who places a white chip on one of the grid units 14 in board 1. For purposes of illustration assume that player A covers the green star in the upper left hand corner of board 1 designated by the numeral 36. Player A must then also place a white chip on the green star 36 on board 2. The players alternate play, each player covering the same symbols 18 on both boards during each play made by that player. A player wins on forming a "straight line" of four of his chips on either the board 1 or the board 2. A player who forms a line of three chips, in line with a vacant grid unit 14 and is thus able to win on the next move must state "check"; a player under check must block the threatened line by inserting a chip on the vacant grid unit, covering the same symbol on the second board. In order to win, therefore, a player must develop two lines of three chips.

In this invention, the use of the two boards guarantees that the winning pattern of numbers is a straight line on only one board and presents a rather irregular pattern on the other board.

In constructing the boards 1 and 2, the symbols 18 are first arranged in a random pattern on board 1, such as shown in FIG. 1. The symbols on board 2 are located pursuant to the following algebraic equations:

$$x'=a+bx+ay$$

$$y'=b+ax+by$$

wherein:

x=a coordinate 0, 1, a or b on the horizontal axis of board 1 y=the coordinates 0, 1, a, b on the vertical axis for board 1 x'=one of said coordinates on the horizontal axis of board 2 y'=one of said coordinates on the vertical axis of board 2 and wherein a and b come from a field of four elements 0, 1, a, and b, corresponding to the axis coordinates 0, 1, a, b and where addition and multiplication coordinates in the field are set forth below.

Also set forth below are replicas of boards 1 and 2 showing the coordinates along the x and y axes for board 1 and the x' and y' axes for board 2. For example, the symbol 36 is located at (o,b) on board 1 and (b,I) on board 2. In the replication below, the symbols are identified by the numerals 1–16, inclusive. For example, the green star 36 is represented by the numeral "1" and derivation 1 below details the mathematics necessary to locate the green star 36 on board 2. The mathematical work for locating the remaining symbols on board 2, given board 1, are set forth below.

| + | 0 | 1 | a | b |
|---|---|---|---|---|
| 0 | 0 | 1 | a | b |
| 1 | 1 | 0 | b | a |
| a | a | b | 0 | 1 |
| b | b | a | 1 | 0 |

addition

| * | 0 | 1 | a | b |
|---|---|---|---|---|
| 0 | 0 | 0 | 0 | 0 |
| 1 | 0 | 1 | a | b |
| a | 0 | a | b | 1 |
| b | 0 | b | 1 | a |

multiplication

| | | | | |
|---|---|---|---|---|
| b | 1 (0,b) | 2 (1,b) | 3 (a,b) | 4 (b,b) |
| a | 5 (0,a) | 6 (1,a) | 7 (a,a) | 8 (b,a) |
| 1 | 9 (0,1) | 10 (1,1) | 11 (a,1) | 12 (b,1) |
| 0 | 13 (0,0) | 14 (1,0) | 15 (a,0) | 16 (b,0) |
| | 0 | 1 | a | b |

board 1

| | | | | |
|---|---|---|---|---|
| b | 2 (0,b) | 11 (1,b) | 13 (a,b) | 8 (b,b) |
| a | 16 (0,a) | 5 (1,a) | 3 (a,a) | 10 (b,a) |
| 1 | 7 (0,1) | 14 (1,1) | 12 (a,1) | 1 (b,1) |
| 0 | 9 (0,0) | 4 (1,0) | 6 (a,0) | 15 (b,0) |
| | 0 | 1 | a | b |

board 2

####################################
1 on board 1 is (0,b)
(x,y) = (0,b)

| | |
|---|---|
| $x' = a + bx + ay$ | $y' = b + ax + by$ |
| $x' = a + b \cdot 0 + a \cdot b$ | $y' = b + a \cdot 0 + b \cdot b$ |
| $x' = a + 0 + 1$ | $y' = b + 0 + a$ |
| $x' = a + 1$ | $y' = b + a$ |
| $x' = b$ | $y' = 1$ |

(x',y') = (b,1)
1 on board 2 is (b,1)
####################################
2 on board 1 is (1,b)
(x,y) = (1,b)

| | |
|---|---|
| $x' = a + bx + ay$ | $y' = b + ax + by$ |
| $x' = a + b \cdot 1 + a \cdot b$ | $y' = b + a \cdot 1 + b \cdot b$ |
| $x' = a + b + 1$ | $y' = b + a + a$ |
| $x' = 1 + 1$ | $y' = 1 + a$ |
| $x' = 0$ | $y' = b$ |

(x',y') = (0,b)
2 on board 2 is (0,b)
####################################
3 on board 1 is (a,b)
(x,y) = (a,b)

| | |
|---|---|
| $x' = a + bx + ay$ | $y' = b + ax + by$ |
| $x' = a + b \cdot a + a \cdot b$ | $y' = b + a \cdot a + b \cdot b$ |
| $x' = a + 1 + 1$ | $y' = b + b + a$ |
| $x' = b + 1$ | $y' = 0 + a$ |
| $x' = a$ | $y' = a$ |

(x',y') = (a,a)
3 on board 2 is (a,a)
####################################
4 on board 1 is (b,b)
(x,y) = (b,b)

| | |
|---|---|
| $x' = a + bx + ay$ | $y' = b + ax + by$ |
| $x' = a + b \cdot b + a \cdot b$ | $y' = b + a \cdot b + b \cdot b$ |
| $x' = a + a + 1$ | $y' = b + 1 + a$ |
| $x' = 0 + 1$ | $y' = a + a$ |
| $x' = 1$ | $y' = 0$ |

(x',y') = (1,0)
4 on board 2 is (1,0)
####################################

5 on board 1 is (0,a)
(x,y) = (0,a)

| | |
|---|---|
| $x' = a + bx + ay$ | $y' = b + ax + by$ |
| $x' = a + b \cdot 0 + a \cdot a$ | $y' = b + a \cdot 0 + b \cdot a$ |
| $x' = a + 0 + b$ | $y' = b + 0 + 1$ |
| $x' = a + b$ | $y' = b + 1$ |
| $x' = 1$ | $y' = a$ |

(x',y') = (1,a)
5 on board 2 is (1,a)
####
6 on board 1 is (1,a)
(x,y) = (1,a)

| | |
|---|---|
| $x' = a + bx + ay$ | $y' = b + ax + by$ |
| $x' = a + b \cdot 1 + a \cdot a$ | $y' = b + a \cdot 1 + b \cdot a$ |
| $x' = a + b + b$ | $y' = b + a + 1$ |
| $x' = a + 0$ | $y' = 1 + 1$ |
| $x' = a$ | $y' = 0$ |

(x',y') = (a,0)
6 on board 2 is (a,0)
####
7 on board 1 is (a,a)
(x,y) = (a,a)

| | |
|---|---|
| $x' = a + bx + ay$ | $y' = b + ax + by$ |
| $x' = a + b \cdot a + a \cdot a$ | $y' = b + a \cdot a + b \cdot a$ |
| $x' = a + 1 + b$ | $y' = b + b + 1$ |
| $x' = b + b$ | $y' = 0 + 1$ |
| $x' = 0$ | $y' = 1$ |

(x',y') = (0,1)
7 on board 2 is (0,1)
####
8 on board 1 is (b,a)
(x,y) = (b,a)

| | |
|---|---|
| $x' = a + bx + ay$ | $y' = b + ax + by$ |
| $x' = a + b \cdot b + a \cdot a$ | $y' = b + a \cdot b + b \cdot a$ |
| $x' = a + a + b$ | $y' = b + 1 + 1$ |
| $x' = 0 + b$ | $y' = a + 1$ |
| $x' = b$ | $y' = b$ |

(x',y') = (b,b)
9 on board 2 is (b,b)
####
9 on board 1 is (0,1)
(x,y) = (0,1)

| | |
|---|---|
| $x' = a + bx + ay$ | $y' = b + ax + by$ |
| $x' = a + b \cdot 0 + a \cdot 1$ | $y' = b + a \cdot 0 + b \cdot 1$ |
| $x' = a + 0 + a$ | $y' = b + 0 + b$ |
| $x' = a + a$ | $y' = b + b$ |
| $x' = 0$ | $y' = 0$ |

(x',y') = (0,0)
9 on board 2 is (0,0)
####
10 on board 1 is (1,1)
(x,y) = (1,1)

| | |
|---|---|
| $x' = a + bx + ay$ | $y' = b + ax + by$ |
| $x' = a + b \cdot 1 + a \cdot 1$ | $y' = b + a \cdot 1 + b \cdot 1$ |
| $x' = a + b + a$ | $y' = b + a + b$ |
| $x' = 1 + a$ | $y' = 1 + b$ |

| | |
|---|---|
| $x' = b$ | $y' = a$ |

(x',y') = (b,a)
10 on board 2 is (b,a)
####
11 on board 1 is (a,1)
(x,y) = (a,1)

| | |
|---|---|
| $x' = a + bx + ay$ | $y' = b + ax + by$ |
| $x' = a + b \cdot a + a \cdot 1$ | $y' = b + a \cdot a + b \cdot 1$ |
| $x' = a + 1 + a$ | $y' = b + b + b$ |
| $x' = b + a$ | $y' = 0 + b$ |
| $x' = 1$ | $y' = b$ |

(x',y') = (1,b)
11 on board 2 is (1,b)
####
12 on board 1 is (b,1)
(x,y) = (b,1)

| | |
|---|---|
| $x' = a + bx + ay$ | $y' = b + ax + by$ |
| $x' = a + b \cdot b + a \cdot 1$ | $y' = b + a \cdot b + b \cdot 1$ |
| $x' = a + a + a$ | $y' = b + 1 + b$ |
| $x' = 0 + a$ | $y' = a + b$ |
| $x' = a$ | $y' = 1$ |

(x',y') = (a,1)
12 on board 2 is (a,1)
####
13 on board 1 is (0,0)
(x,y) = (0,0)

| | |
|---|---|
| $x' = a + bx + ay$ | $y' = b + ax + by$ |
| $x' = a + b \cdot 0 + a \cdot 0$ | $y' = b + a \cdot 0 + b \cdot 0$ |
| $x' = a + 0 + 0$ | $y' = b + 0 + 0$ |
| $x' = a + 0$ | $y' = b + 0$ |
| $x' = a$ | $y' = b$ |

(x',y') = (a,b)
13 on board 2 is (a,b)
####
14 on board 1 is (1,0)
(x,y) = (1,0)

| | |
|---|---|
| $x' = a + bx + ay$ | $y' = b + ax + by$ |
| $x' = a + b \cdot 1 + a \cdot 0$ | $y' = b + a \cdot 1 + b \cdot 0$ |
| $x' = a + b + 0$ | $y' = b + a + 0$ |
| $x' = 1 + 0$ | $y' = 1 + 0$ |
| $x' = 1$ | $y' = 1$ |

(x',y') = (1,1)
14 on board 2 is (1,1)
####
15 on board 1 is (a,0)
(x,y) = (a,0)

| | |
|---|---|
| $x' = a + bx + ay$ | $y' = b + ax + by$ |
| $x' = a + b \cdot a + a \cdot 0$ | $y' = b + a \cdot a + b \cdot 0$ |
| $x' = a + 1 + 0$ | $y' = b + b + 0$ |
| $x' = b + 0$ | $y' = 0 + 0$ |
| $x' = b$ | $y' = 0$ |

(x',y') = (b,0)
15 on board 2 is (b,0)
####
16 on board 1 is (b,0)
(x,y) = (a,0)

| | |
|---|---|
| $x' = a + bx + ay$ | $y' = b + ax + by$ |
| $x' = a + b \cdot b + a \cdot 0$ | $y' = b + a \cdot b + b \cdot 0$ |

-continued

| | |
|---|---|
| x' = a + a + 0 | y' = b + 1 + 0 |
| x' = 0 + 0 | y' = a + 0 |
| x' = 0 | y' = a |

(x',y') = (0,a)
16 on board 2 is (0,a)
####################################
Matching of numbers and icons (board 1):
1. green star
2. blue diamond
3. yellow "4-squares"
4. red "4-triangles" (or Maltese cross)
5. blue "4-triangles"
6. green "4-squares"
7. red star
8. yellow "4-triangles"
9. yellow star
10. red diamond
11. green "4-triangles"
12. blue star
13. red "4-squares"
14. yellow diamond
15. blue "4-squares"
16. green diamond From the above description, it is seen that this invention provides a fairly sophisticated and more difficult game for the Tic Tac Toe family of games. This is due to the two board concept and the mathematical derivation of board 2 from board 1. Numerals such as 20, 22, 24 and 26 have been used in the description to locate symbols 18 in grid units 14. However, coordinates based on horizontal row numbers and vertical column numbers can also be used, for example, the rows 28 could be numbered 1,2,3,4 starting with the top row. The columns 30 could be numbered 1,2,3,4 starting with the column at the extreme left of the grid 12. The location of a grid unit 14 and/or a symbol 18 on boards 1 and 2 could then be located by its x, y and x', y' coordinates, respectively. For example, the "four triangles" symbol 26 is the upper right hand corner of board 1 is located at (4,1). The "four squares" symbol 24 in the lower right hand corner of board 2 is (4,4).

While the above description constitutes the preferred embodiments of the present invention, it will be appreciated that the invention is susceptible to modification, variation and change without departing from the proper scope and fair meaning of the accompanying claims.

We claim:

1. A method of playing a game between first and second players, comprising the steps of:

providing first and second square matrix grid game boards, each containing a square grid playing area defined by a plurality of grid units existing in a plurality of horizontal, vertical, and diagonal rows, each of said boards containing an identical set of grid unit identification symbols, with the symbols on said first board being arranged in locations different from the symbols on said second board, and providing first and second sets of visually distinguishable game playing pieces to be placed on said grid units, each of said grid units being capable of containing one of said game playing pieces thereon so as to at least partially cover said grid unit;

providing a set of each of said game pieces to each of said players; and each player placing two of said game pieces, one each onto the same grid unit identification symbol of each board in alternating fashion until one of said players has covered an entire row of said grid units on one of said boards to determine the winner of the game.

2. The method of claim 1 wherein the symbols on each board have shapes and colors which distinguish them from all the other symbols on said board.

3. The method of claim 1 wherein each square grid consists of four grid units in each of said criss cross and diagonal rows.

4. The method of claim 3 wherein the symbols on each board are defined by colors and shapes, each game board having symbols of four different colors and four different shapes.

5. The method of claim 1, including the step of arranging the symbols on each board in accordance with a mathematical formula.

6. The method of claim 1, including the step of providing said first and said second game boards in electronic form for use by said two players.

7. A mathematical formula based board game apparatus for at least two players, comprising:

first and second square matrix grid game boards, each board containing a square grid playing area defined by the same number of grid units arranged in a plurality of horizontal, vertical and diagonal rows, such that each grid unit of the first board has a corresponding grid unit on the second board, each of said grid units being sized to receive a game playing piece which at least partially covers said grid unit when placed thereon, wherein logical deployment of a plurality of said game playing pieces by said players during alternating designated turns to cover an entire row of said grid units on one of said boards determines the winner of the game, each of said boards further displaying an identical set of grid unit identification symbols, with each grid unit containing only one of said symbols, board being the same as but located on different grid units from the other one of said boards, both boards containing the same number of the symbols on said first board being arranged in a random pattern, the symbols on said second board being arranged so that none of the symbols displayed thereon are located on the same grid units as any of the corresponding grid units of said first board, said arrangement of symbols on said second board being located pursuant to the formulas:

$$x'=a+bx+ay$$

$$y'=b+ax+by$$

wherein:

x=a horizontal coordinate 0, 1, a or b on said first board, y=a vertical coordinate 0, 1, a or b on said first board, x'=the corresponding horizontal coordinate on said second board, and y'=the corresponding vertical coordinate on said second board; and wherein addition and multiplication of said coordinates are defined as follows:

| + | 0 | 1 | a | b |
|---|---|---|---|---|
| 0 | 0 | 1 | a | b |
| 1 | 1 | 0 | b | a |
| a | a | b | 0 | 1 |
| b | b | a | 1 | 0 |

addition

| * | 0 | 1 | a | b |
|---|---|---|---|---|
| 0 | 0 | 0 | 0 | 0 |
| 1 | 0 | 1 | a | b |
| a | 0 | a | b | 1 |
| b | 0 | b | 1 | a |

multiplication.

8. The board game apparatus according to claim 7 wherein the symbols on each board are of different colors and shapes so that no two symbols on said each board are of the same shape and color.

9. The board game apparatus according to claim 7 wherein each square grid consists of four grid units in each of said criss cross and diagonal rows.

10. The board game apparatus according to claim 9 wherein the symbols are all defined by colors and shapes, each game board having symbols of four different colors and four different shapes.

* * * * *

UNITED STATES PATENT AND TRADEMARK OFFICE

CERTIFICATE OF CORRECTION

PATENT NO. : 5,611,538

DATED : March 18, 1997

INVENTOR(S) : Ehrenfeucht

It is certified that error appears in the above-indentified patent and that said Letters Patent is hereby corrected as shown below:

Column 8, lines 42-46: After "symbols," delete "board being the same as but located on different grid units from the other one of said boards, both boards containing the same number of".

Signed and Sealed this

Thirtieth Day of September, 1997

*Attest:*

*Attesting Officer*

BRUCE LEHMAN

*Commissioner of Patents and Trademarks*